US005501618A

United States Patent [19]

Muta et al.

[11] Patent Number: 5,501,618

[45] Date of Patent: Mar. 26, 1996

[54] L-SHAPED BULB SOCKET

[75] Inventors: Junji Muta; Yoshiaki Furuta, both of Yokkaichi, Japan

[73] Assignee: Sumitomo Wiring Systems, Ltd., Japan

[21] Appl. No.: 344,455

[22] Filed: Nov. 23, 1994

[30] Foreign Application Priority Data

Nov. 25, 1993 [JP] Japan ..... 5-320946

[51] Int. Cl.[6] ..... H01R 13/436

[52] U.S. Cl. ..... 439/699.2; 439/752

[58] Field of Search ..... 439/699.2, 752

[56] References Cited

U.S. PATENT DOCUMENTS

| | | | |
|---|---|---|---|
| 4,752,241 | 6/1988 | Matsuoka et al. | 439/699.2 |
| 5,000,702 | 3/1991 | Forish et al. | 439/699.2 |
| 5,080,615 | 1/1992 | Kondo | 439/699.2 |

FOREIGN PATENT DOCUMENTS 137588 8/1987 Japan .

*Primary Examiner*—Gary F. Paumen

*Attorney, Agent, or Firm*—Jordan B. Bierman; Bierman and Muserlian

[57] ABSTRACT

This invention aims to prevent terminal metal fixtures in an L-shaped bulb socket from being exposed and to positively hold the fixtures. Each terminal metal fixture (metal terminal) 1 is inserted into a fixture accommodating chamber 15 in an axial direction of a connector inlet port 9 through a fixture insertion opening 17 formed in a rear wall of a housing 7 while a male terminal 5 of the fixture 1 is being fitted to a through-hole 14 formed in a fixture holding wall 13. Then, a lid member 19 is thrusted in the opening 17 in an axial direction of a bulb inlet port 8 on a thrust groove 21 formed in an end face of the bulb inlet port 8. Thus, the opening 17 is covered by the lid member 19. A side plate 4 of clamp portions 2 of each terminal metal fixture 1 is clamped in a space between a stepped face 24 on the housing 7 and the lid member 19, thereby preventing the fixture 1 from moving vertically or horizontally. Also, the male terminal 5 is closely fitted in the through-hole 14, thereby preventing the fixture 1 from moving.

4 Claims, 4 Drawing Sheets

L-SHAPED BULB SOCKET

BACKGROUND OF THE INVENTION (1) Field of the Invention

This invention relates to an L-shaped bulb socket in which a bulb inlet port is arranged to be perpendicular to a connector inlet port.

(2) Statement of the Prior Art

Heretofore, for example, a light device for an automobile has utilized an L-shaped bulb socket, which has a bulb inlet port and a connector inlet port arranged to be perpendicular to the bulb inlet port and accommodates terminal metal fixtures each of which has a pair of clamp portions adapted to hold each terminal of a bulb and a male terminal joined perpendicularly to the clamp portions.

Such a conventional L-shaped bulb socket is generally made by insert-molding the terminal metal fixtures (metal terminals). However, a process of producing the socket requires much labor. Thus, a method of assembling the socket has been developed. An example thereof is disclosed in Japanese Utility Model Publication No. 62-137588 (1987).

For convenience of explanation, a conventional L-shaped bulb socket will be described below by referring to FIGS. 4 and 5. FIG. 4 is a longitudinal sectional view of the conventional L-shaped bulb socket and FIG. 5 is a front elevational view taken along lines V—V in FIG. 4.

As shown in FIGS. 4 and 5, the L-shaped bulb socket is provided in its housing with an L-shaped fixture accommodating chambers d which include a bulb inlet port b and a connector inlet port c arranged perpendicularly to the bulb inlet port b. The housing a is provided in its front portion with slots e which extend from the bulb inlet port b to the connector inlet port c. Terminal metal fixtures d are pushed into the fixture accommodating chambers d through the slots e. When an elastic lock piece h projected from a side face of clamp portions g of each terminal metal fixture d engages with a recess i formed in a side wall of each chamber d, the fixture d is secured in the chamber d.

However, since the slots e are left open even after the terminal metal fixtures f are inserted in the housings a, any conductive elements can easily enter the slots e to contact with the fixture f.

Since the terminal metal fixture f is prevented from coming out of the housing a only by engagement of the elastic lock piece h and recess i, the fixture is readily subject to vibration and consequent detachment from the housing a.

SUMMARY OF THE INVENTION

An object of the present invention is to provide an L-shaped bulb socket which prevents a terminal metal fixture from being exposed and can positively hold the terminal metal fixture.

In order to achieve the above object, an L-shaped bulb socket comprises: a housing having a bulb inlet port, a connector inlet port, a pair of fixture accommodating chambers, and a fixture insertion opening formed in a wall opposite to the connector inlet port, the bulb inlet port being arranged to be perpendicular to the connector inlet port in the housing; a pair of terminal metal fixtures (metal terminals) disposed in the respective fixture accommodating chambers, each terminal metal fixture having a pair of clamp portions adapted to hold each terminal of a bulb and a terminal portion adapted to be connected to each terminal of a connector, the terminal portion being perpendicularly joined to the clamp portions; and a lid member mounted on the fixture insertion opening slidably in a bulb inserting direction to cover the opening and press the fixtures inwardly.

The fixture accommodating chambers are provided at their bent portions with a terminal support wall which contacts with distal ends of the clamp portions of the terminal metal fixtures. The support walls are provided with an aperture to which a male terminal portion of said terminal metal fixture is closely fitted.

The fixture insertion opening is formed in a side wall of the housing. The lid member covers the opening and a part of the wall.

An operation of the L-shaped bulb socket of the present invention will be explained below. When the terminal metal fixture is inserted into the chamber in the housing through the opening and then the lid member is mounted on the opening, the fixture is pressed to be held in the chamber and the opening is closed. Since the lid member slides on the opening in a bulb inserting direction which is perpendicular to a fixture inserting direction, the lid member can close the space in a coming-out direction of the fixture.

Since the lid member covers the fixture insertion opening, the terminal metal fixtures are not exposed, thereby preventing any undesirable electrical contact. Also, since the terminal metal fixtures are clamped between the lid member and the wall of the chamber, it is possible to prevent the fixtures from being disturbed by vibration and becoming detached from the housing.

Since the male terminal of each terminal metal fixture is press-fitted in the through-hole in the terminal holding wall, the fixture is secured in the chamber so as to be prevented from moving vertically or horizontally in the fixture inserting direction, thereby preventing the terminal metal fixture from vibrating in the chamber.

A work of inserting the terminal metal fixtures into the housing can be simplified because a space to receive the fixtures is sufficiently large.

DETAILED DESCRIPTION OF THE PREFERRED EMBODIMENTS

Figure 1:
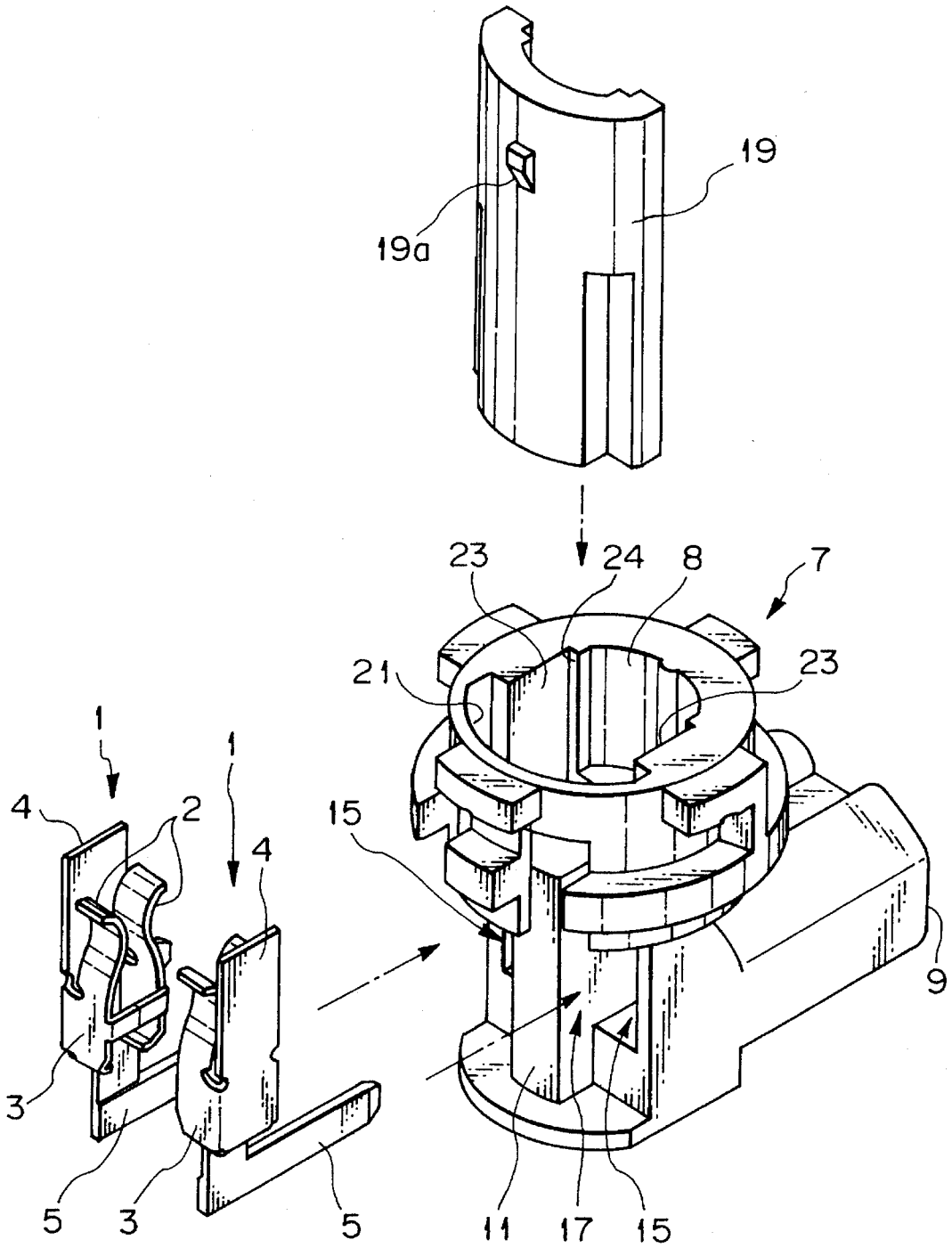
FIG. 1 is an exploded perspective view of an embodiment of an L-shaped bulb socket in accordance with the present invention.

An embodiment of an L-shaped bulb socket in accordance with the present invention will be explained below by referring to FIGS. 1 through 3.

In the illustrated embodiment, each of a pair of terminal metal fixtures (metal terminals) 1 includes a pair of elastic clamp portions 2 adapted to hold a terminal 31 of a bulb 30

(see FIG. 3), a side plate 4, a pair of connecting plates 3 which couple the respective clamp portions 2 to the side plate 4, and a male terminal 5 which is joined to the clamp portions 2 through connecting plates 3 to form an L-shaped configuration.

A housing 7 made of a synthetic resin material has an L-shaped configuration and is provided at one end with a bulb inlet port 8 and at the other end with a connector inlet port 9. The bulb inlet port 8 and connector inlet port 9 are arranged perpendicularly to each other.

As shown in FIG. 1, an inner part of the bulb inlet port 8 is divided into right and left chambers by a partition 11. As shown in FIG. 2A, the connector inlet port 9 is provided at its inner section with a terminal holding wall 13 which receives the connecting plates 3 of the terminal metal fixture 1. The terminal holding wall 13 is provided with right and left through-holes 14 which closely receive the respective male terminals 5 of the respective terminal metal fixtures 1.

Thus, the housing 7 is provided in its interior with right and left fixture accommodating chambers 15 which bring the bulb inlet port 8 and connector inlet port 9 into communication with each other.

The housing 7 is provided in a rear wall opposite from the connector inlet port 9 with a fixture insertion opening 17 formed in an axial direction of the connector inlet port 9. In particular, the opening 17 is formed in a lower end of the whole rear wall and a part of the side wall.

The housing 7 includes an arcuated lid member 19 made of a synthetic resin material and adapted to cover the opening 17.

The housing 7 is provided on a rear side of a mouth edge of the bulb inlet port 8 in the housing 7 with an arcuated groove 21 adapted to receive the lid member 19. The lid member 19 is inserted into the groove 21 and enters the opening 17 while passing on an outer face of the partition 11 in an axial direction of the bulb inlet port 8. The lid member 19 is provided on its rear side with a lock projection 19*a*.

As shown in FIG. 1, the bulb inlet port 8 is provided in opposite sides of its inner periphery with stepped recesses 23 which are parallel to the axial direction of the connector inlet port 9 and support rear sides of the side plate of the terminal metal fixtures 1. An upper end side edge of each recess 23 defines each side edge of the groove 21. A thickness of the lid member 19 is designed so that opposite side edges of the lid member 19 project inwardly from the recess 23 when the lid member 19 is inserted in the opening 17.

Next, steps of assembling the present embodiment will be explained below.

As shown in FIG. 2A, each terminal metal fixture 1 is inserted into the corresponding fixture accommodating chamber 15 through the opening 17 formed in the rear wall of the housing 7 in the axial direction of the connector inlet port 9 while the male terminal 5 is entering the through-hole 14 in the terminal holding wall 13. This insertion of each fixture 1 is continued until the connecting plates 3 abut on the wall 13. At this time, the side plate 4 of the fixture 1 engages with the recess 23 in the bulb inlet port 8 and abuts on the stepped face 24 at its front side edge.

A work of inserting the terminal metal fixture 1 into the chamber 15 can be easily carried out because the lower part of the opening 17 is widened.

Figure 2B:
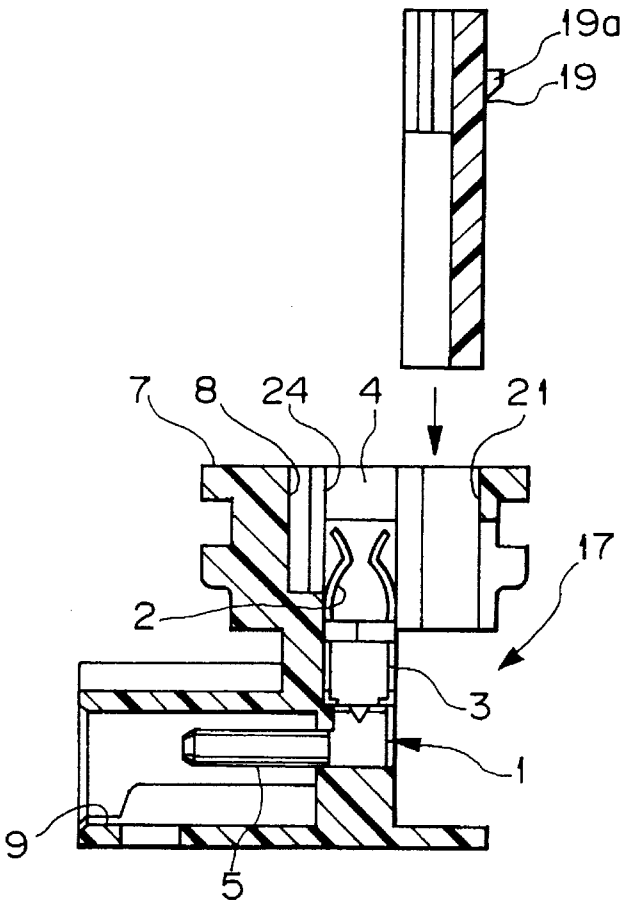
FIGS. 2A and 2B are exploded longitudinal sectional views of the L-shaped bulb socket, illustrating a process for inserting a terminal metal fixture into a housing (A) and a process for thrusting a lid member in a fixture insertion opening.
Figure 2A:
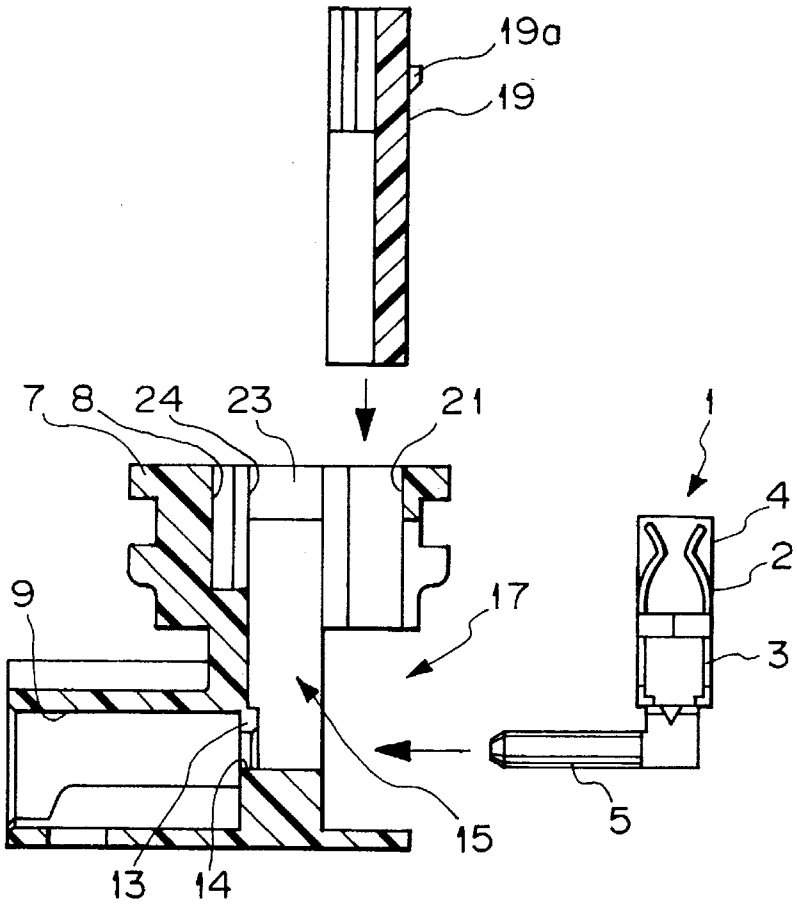

Next, as shown in FIG. 2B, the lid member 19 is inserted into the groove 21 in the end face of the bulb inlet port 8 along the outer face of the partition 11 in the axial direction of the bulb inlet port 8.

Figure 3:
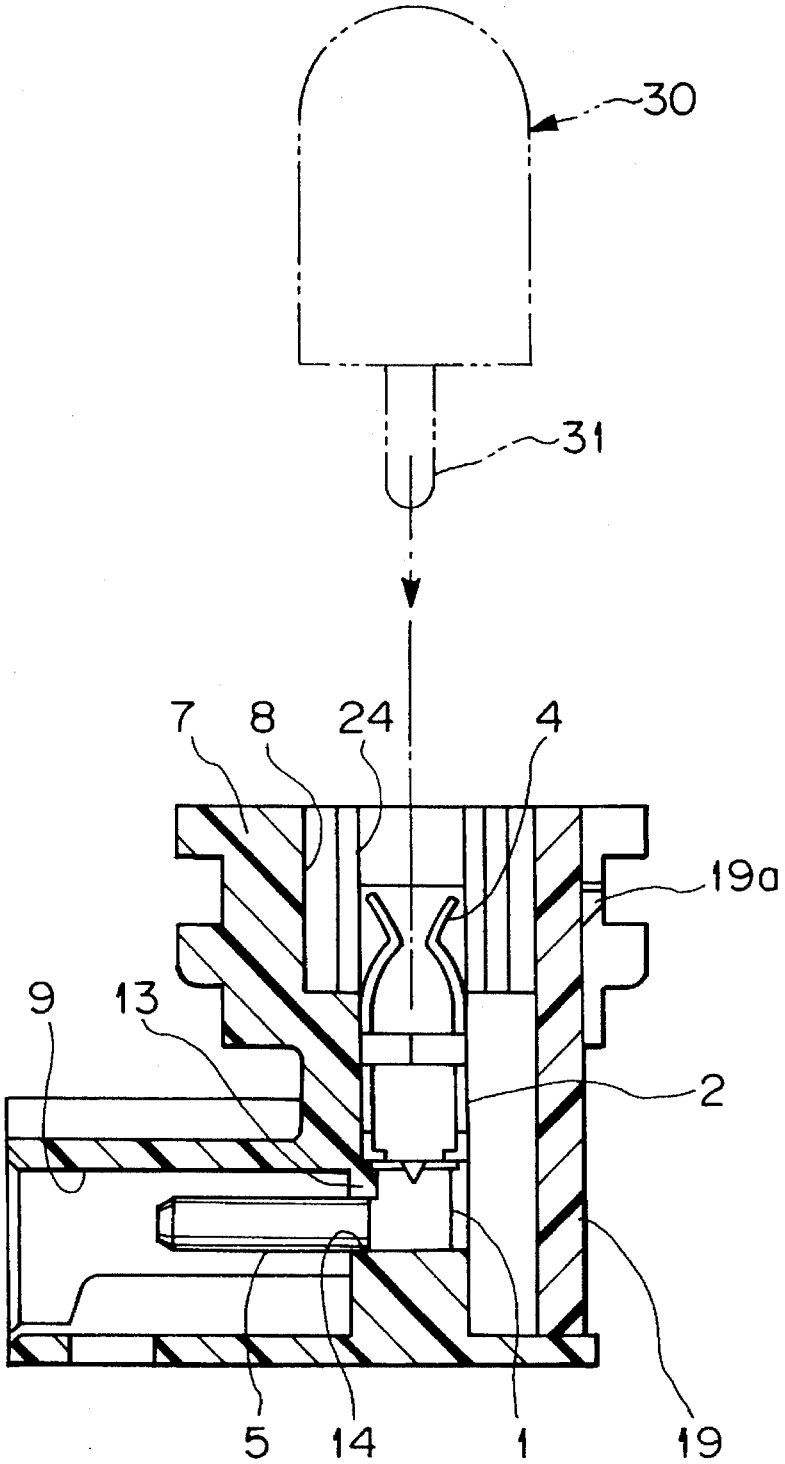
FIG. 3 is a longitudinal sectional view of the embodiment in an assembled state.
Figure 4:
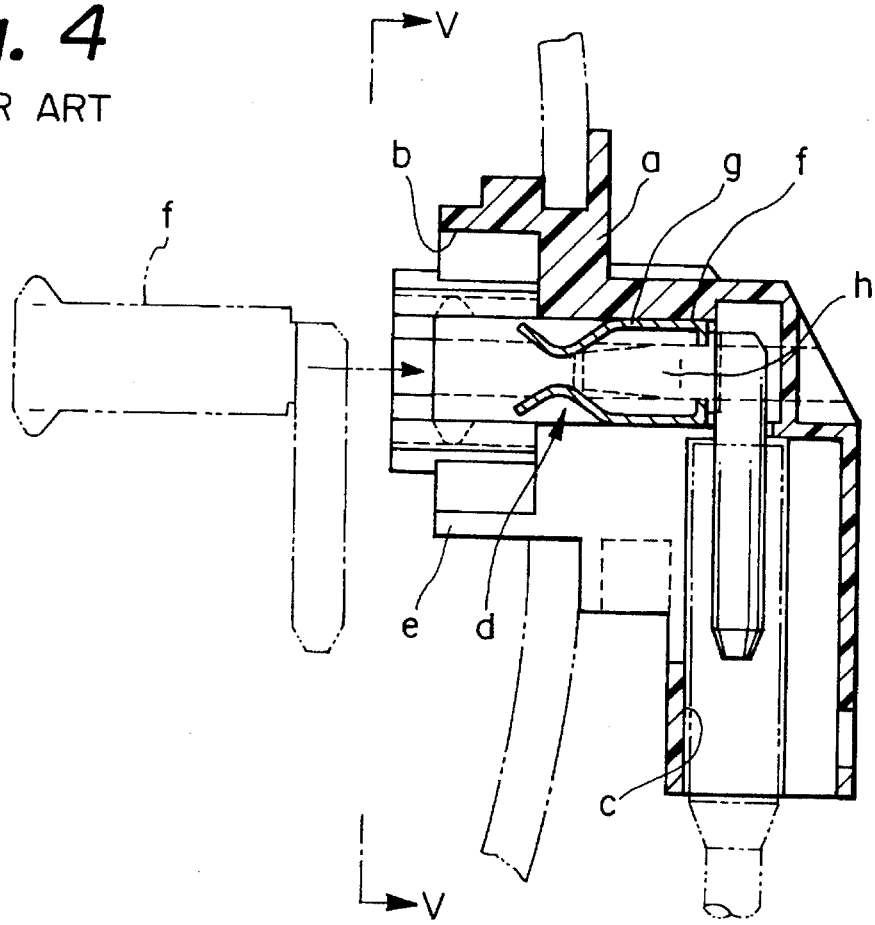
Fig. 4 PRIOR ART
FIG. 4 is a longitudinal sectional view of a conventional L-shaped bulb socket.
Figure 5:
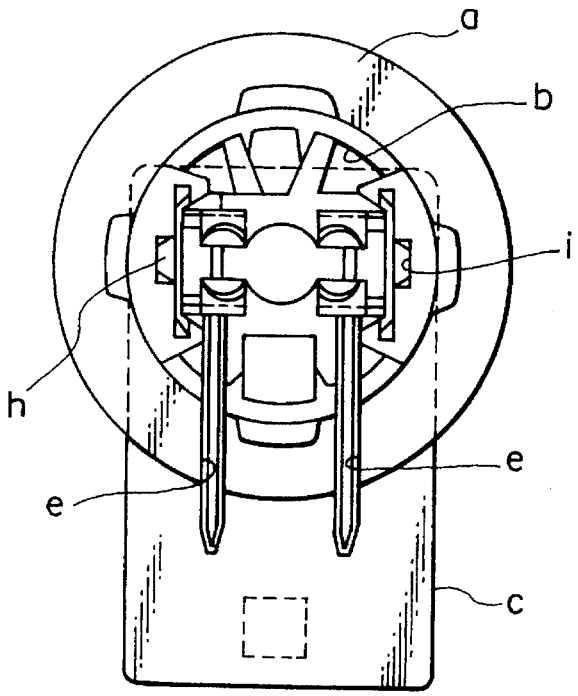
Fig. 5 PRIOR ART
FIG. 5 is a front elevational view of the conventional L-shaped bulb socket taken along lines V—V in FIG. 4.

Consequently, as shown in FIG. 3, the opening 17 in the housing 7 is closed by the lid member 19 and the side plate 4 of the fixture 1 is clamped between the stepped face 24 of the recess 23 and the lid member 19, thereby preventing the fixture 1 from moving forwardly and rearwardly in the inserting direction of the fixture 1. Since the male terminal 5 of each terminal metal fixture 1 is press-fitted in the through-hole 14 in the terminal holding wall 13, the fixture 1 is secured in the chamber 15 not to move up and down, and right and left directions in the chamber 15, thereby preventing the fixture 1 from vibrating in the chamber 15. The lock projection 19*a* on the lid member 19 engages with the housing 7, thereby preventing the fixture 1 from falling out of the housing 7.

The bulb 30 is inserted into the assembled L-shaped bulb socket through the bulb inlet port 8 (see FIG. 3). A mating female connector not shown is inserted into a connector inlet port 9.

According to the L-shaped bulb socket of the present invention, the terminal metal fixtures 1 are not exposed because the lid member 19 covers the opening 17, the fixtures 1 are held in the chamber 15 so as not to move either vertically or horizontally, and the fixtures do not vibrate in the chamber 15 on become detached therefrom.

Although a male terminal metal fixture is used in the above embodiment, a cylindrical female metal fixture may be used.

What is claimed is:

1. An L-shaped bulb socket comprising:

a housing having a bulb inlet port, a connector inlet port, a pair of terminal accommodating chambers, and a terminal insertion opening formed in a wall opposite to said connector inlet port, said bulb inlet port being arranged to be perpendicular to said connector inlet port in said housing;

a pair of metal terminals disposed in said respective terminal accommodating chambers, each metal terminals having a pair of clamp portions adapted to hold a respective terminal of a bulb and a terminal portion adapted to be connected to each terminal of a connector, said terminal portion extending perpendicularly to said clamp portions; and a lid member mounted on said terminal insertion opening slidably in a bulb inserting direction to cover said opening and retain said metal terminals in said housing.

2. An L-shaped bulb socket according to claim 1, wherein said terminal accommodating chambers are provided at bent portions thereof with a terminal support wall which contacts with distal ends of said clamp portions of said metal terminals, and wherein said support walls are each provided with an aperture to which a said terminal portion of a respective said metal terminal fixture is closely fitted.

3. An L-shaped bulb socket according to claim 1, wherein said terminal insertion opening is formed in a side wall of said housing, and wherein said lid member covers said opening and a part of said side wall.

4. An L-shaped bulb socket according to claim 2, wherein said terminal insertion opening is formed in a side wall of said housing, and wherein said lid member covers said opening and a part of said side wall.

* * * * *